United States Patent [19]

Sakai et al.

[11] 3,969,117

[45] July 13, 1976

[54] LITHOGRAPHIC DEVELOPING PROCESS UTILIZING A SILVER HALIDE PHOTOGRAPHIC MATERIAL CONTAINING HYDROIMIDAZO-S-TRIAZINE AND POLYALKYLENE OXIDE DERIVATIVE

[76] Inventors: Hidemaru Sakai, 940-18 Utsuki-cho, Hachioji, Tokyo; Shigeji Baba, 1017, Sagamidai, Zama, Koza, Kanagawa, both of Japan

[22] Filed: June 11, 1974

[21] Appl. No.: 478,397

Related U.S. Application Data

[63] Continuation of Ser. No. 280,713, Aug. 14, 1972, abandoned, which is a continuation-in-part of Ser. No. 72,501, Sept. 15, 1970, abandoned.

[30] Foreign Application Priority Data

Sept. 22, 1969 Japan ..... 44-74675

[52] U.S. Cl. ..... 96/66 R; 96/107; 96/109; 96/95; 96/663

[51] Int. Cl.[2] ..... G03C 5/20

[58] Field of Search ..... 96/66.3, 66.4, 66 R, 96/107, 109, 95

[56] References Cited

UNITED STATES PATENTS

| | | | |
|---|---|---|---|
| 3,345,175 | 10/1967 | Hayakawa et al. | 96/107 |
| 3,663,209 | 5/1972 | Sato et al. | 96/109 |

*Primary Examiner*—Won H. Louie, Jr.
*Attorney, Agent, or Firm*—Haseltine, Lake & Waters

[57] ABSTRACT

A lith-type light-sensitive silver halide photographic material which gives a hard tone and sharp dot image contains in the emulsion layer or one of the layers adjacent thereto a hydroimidazo-s-triazine compound and a polyalkylene oxide derivative.

3 Claims, No Drawings

LITHOGRAPHIC DEVELOPING PROCESS UTILIZING A SILVER HALIDE PHOTOGRAPHIC MATERIAL CONTAINING HYDROIMIDAZO-S-TRIAZINE AND POLYALKYLENE OXIDE DERIVATIVE

CROSS REFERENCE TO RELATED APPLICATIONS

This application is a continuation application of Ser. No. 280,713, filed Aug. 14, 1972, which is a continuation-in-part application of U.S. Ser. No. 72,501, filed Sept. 15, 1970 both now abandoned.

This invention relates to a light-sensitive silver halide photographic material, particularly to a so-called lith-type light-sensitive silver halide photographic material which gives a hard tone and sharp dot image.

In the modern printing industry, it is an ordinary practice, in printing a continuous tone image, that an original is first photographed on a lith-type light-sensitive material through a contact screen or glass screen to prepare a so-called dot negative (or dot positive), in which the density of the original image has been converted into the size of dot area, and then printing is effected by use of the thus prepared dot negative as a printing master. In this case, the dots formed on the lith-type light-sensitive material are required to be sharp and fringe-free and have extremely high density and contrast. For this reason, there has been widely used for the development of lith-type light-sensitive material a so-called lith developer, i.e. a hard-tone developer containing hydroquinone as a principal ingredient in combination with aldehyde. A photographic image obtained by developing a light-sensitive material with a lith developer is hard in tone, in general. In order to obtain practicallly sufficient sharpness and high contrast, however, the light-sensitive material itself should have such properties as to be particularly suitable for this kind of developer.

It is well known that in order to improve the contrast of an image obtained by lith development, the addition of various polyalkylene oxide derivatives to photographic emulsions is effective. These compounds, however, strongly inhibit the progress of development, so that the development time required for attainment of sufficient image density and contrast becomes extremely long and, if the development is discontinued at a time required for ordinary development, it is impossible to obtain an image having sufficient density and sharpness of dots.

As the result of extensive studies, we have found that in case a hydroimidazo-s-triazine compound and at least one polyalkylene oxide derivative selected from the group consisting of condensation products of alkylene oxides with water, aliphatic alcohols, aliphatic thioalcohols, glycols, fatty acids, amines, phenols, thiophenols, and hexitol derivatives are incorporated into an emulsion layer or a layer adjacent thereto, the above-mentioned drawbacks are overcome to make it possible to obtain a light-sensitive silver halide photographic material which is excellent in initial developability and which gives, within an ordinary development time, sufficiently high light-sensitiveness and contrast as well as excellent dot quality.

The hydroimidazo-s-triazine compounds used in the present invention have antifogging action on silver halide emulsions, so that the incorporation of said compound results in such advantages as to prevent the fog formation liable to be brought about when polyethylene oxide derivatives are incorporated. Further, the hydroimidazo-s-triazine compounds can inhibit the increase of fog during storage of the resulting light-sensitive materials.

The hydroimidazo-s-triazine compounds used in the present invention may be mono, bis or tris, hydroimidazo derivatives of s-triazine having the ring structure

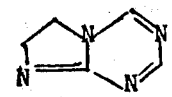

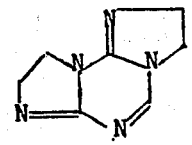

and

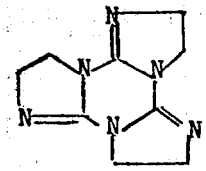

The ring structures may be substituted with hydroxy, lower alkoxy, lower alkyl, amino or amino hydrochloride groups. Moreover, two of the substituted or unsubstituted ring structures may be joined together by a divalent diamino group such as — NH — $(CH_2)_x$— NH — where X = 2 to 6,

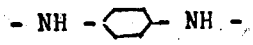

and

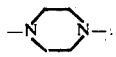

Typical examples of the hydroimidazo-s-triazine compounds used in the present invention are as follows:

(I)

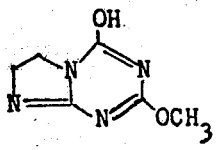

(II)

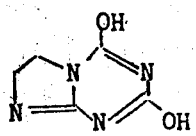

(III)

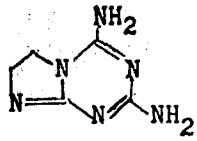

(IV)

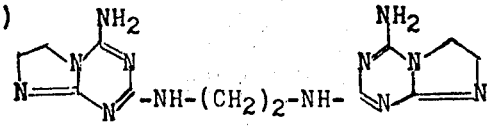

(V)

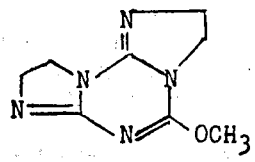

(VI)

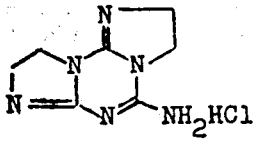

(VII)

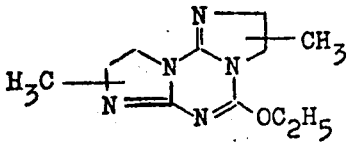

(VIII)

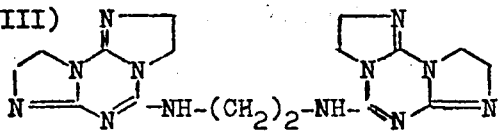

(IX)

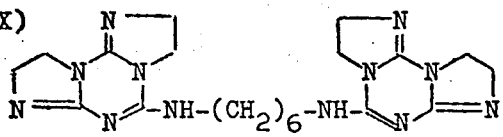

(X)

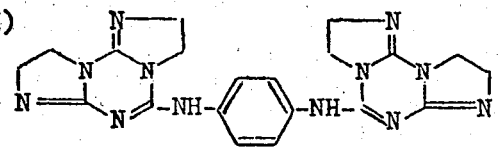

(XI)

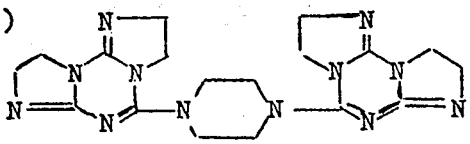

(XII)

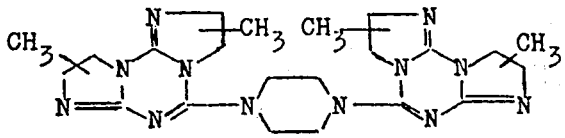

(XIII)

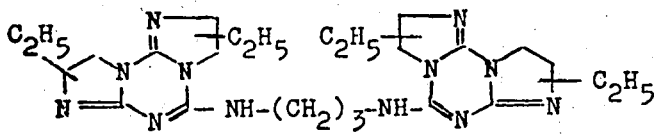

(XIV)

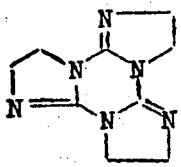

(XV)

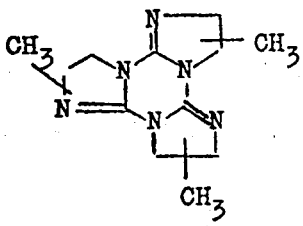

Further, the polyalkylene oxide derivatives used in the present invention are preferably those having a molecular weight of 600 to 8,000. Typical examples of said derivatives are as set forth below.

(1) $HO(C_2H_4O)_{50}H$ (2) 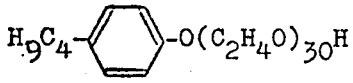

(3) 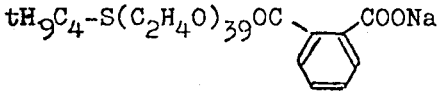

(4) 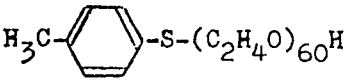

(5) $H(OC_2H_4)_{40}-O-(CH_2)_4-O-(C_2H_4O)_{40}COCH_2CH_2COONa$ (6) 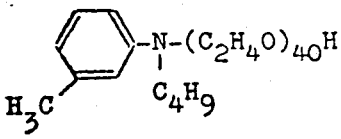

(7) 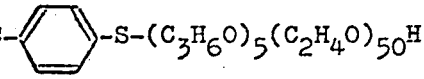

(8) $H(OC_3H_6)_5(OC_2H_4)_{20}O(CH_2)_4O(C_2H_4O)_{20}(C_3H_6O)_5COCH_2CH_2COONa$

The amounts of the above-mentioned 2 kinds of compounds used in the present invention vary depending on the kinds of the compounds and on the properties of the emulsions into which the compounds are incorporated. Preferably, however, the amount of each of the said compounds is in the range of 10 mg. to 10 g. per mol of silver contained in the emulsion.

These compounds may be added at any stage such as at the time of formation of silver halide of the emulsion, or at the time of aging, prior to coating or during preparation of the emulsion. However, the best results are obtained when the compounds are added prior to coating of the emulsion. Each compound is added in the form of a solution in a suitable solvent such as water, alcohol or the like, and may be incorporated not only into an emulsion layer but also into a protective layer, inter layer or the like layer adjacent to the emulsion layer.

Emulsions usable in the present invention include silver chloride, silver chlorobromide, silver bromide, silver iodobromide and silver chloroiodobromide emulsions containing gelatine or the like hydrophilic colloid as protective colloid. These emulsions may have been subjected to chemical sensitization using thiosulfate or the like active sulfur-containing compound, or a gold complex salt, or to optical sensitization using cyanine, merocyanine or the like optical sensitizer. If necessary, the emulsions may have been incorporated with various stabilizers, vehicles and the like common additives for photographic emulsions.

The present invention is illustrated in further detail below with reference to examples.

EXAMPLE 1

A silver chlorobromide emulsion containing 20 mol% of silver bromide was added with suitable amounts of an optical sensitizer, a stabilizer and a hardener, and further with given amounts of a hydroimidazo-s-triazine compound and a polyalkylene oxide derivative, and then coated on a film base, followed by drying. In the above manner, 10 kinds of such samples as shown in Table 1 were prepared.

Table 1

| Sample No. | Kind and amount of compound (per mol of silver) Hydroimidazo-s-triazine compound | Polyalkylene oxide derivative |
|---|---|---|
| 1 | None | None |
| 2 | Compound (V) 0.25 g. | None |
| 3 | None | Compound (1) 0.2 g. |
| 4 | Compound (V) 0.25 g. | Compound (1) 0.2 g. |
| 5 | Compound (IX) 0.1 g. | None |
| 6 | None | Compound (4) 0.1 g. |
| 7 | Compound (IX) 0.1 g. | Compound (4) 0.1 g. |
| 8 | Compound (IV) 0.15 g. | None |
| 9 | None | Compound (5) 0.05 g. |
| 10 | Compound (IV) 0.15 g. | Compound (5) 0.05 g. |

The samples were individually subjected to sensitometry and evaluation of dots.

The sensitometry was effected in such a manner that the sample was brought into close contact with a step-wedge, exposed to a tungsten lamp and then subjected to development, and the relative speed thereof was determined on the basis of the exposure where the density was 1.0. Further, the contrast was expressed in terms of an average gradient between the point where the density was 0.5 and the point where the density was 2.0. The evaluation of dots was carried out in such a manner that the sample was brought into close contact with a contact screen, exposed and then subjected to development under the same conditions as in the case of the sensitometry, and the resulting dots were visually investigated by means of a microscope. The evaluation of dots was represented by each of the ratings 1 to 5, assuming that the rating of dots which were free from fringes and highest in sharpness was 5, and the rating of dots which were extremely large in amount of fringes was 1.

The development was effected at 20°C. at 3 stages of 1 minute 30 seconds, 3 minutes and 4 minutes, using a developer of the following composition:

| | |
|---|---|
| Hot water | 500 ml. |
| Addition product of formaldehyde and sodium sulfite | 50 g. |
| Hydroquinone | 19 g. |
| Sodium carbonate | 80 g. |
| Boric acid | 10 g. |
| Potassium bromide | 2.2 g. |
| Water to make | 1,000 ml. |

The results of the above-mentioned tests were as set forth in Table 2.

Table 2

| Sample No. / Development time | Relative speed 1'30" | 3' | 4' | Contrast 1'30" | 3' | 4' | Evaluation of dots 1'30" | 3' | 4' |
|---|---|---|---|---|---|---|---|---|---|
| 1 | 17 | 100 | 210 | 4.7 | 5.9 | 5.9 | 2 | 2 | 1 |
| 2 | 220 | 350 | 410 | 6.4 | 4.3 | 4.3 | 2 | 1 | 1 |
| 3 | 7 | 66 | 160 | 5.5 | 7.3 | 9.4 | 2 | 3 | 4 |
| 4 | 40 | 140 | 270 | 7.5 | 11.0 | 12.6 | 3 | 4 | 5 |
| 5 | 290 | 390 | 430 | 3.3 | 4.0 | 3.7 | 1 | 1 | 1 |
| 6 | 4 | 40 | 110 | 5.5 | 7.3 | 9.4 | 1 | 3 | 4 |
| 7 | 53 | 180 | 350 | 8.0 | 11.8 | 10.4 | 4 | 5 | 4 |
| 8 | 250 | 340 | 380 | 3.5 | 4.2 | 4.0 | 1 | 1 | 1 |
| 9 | 11 | 75 | 120 | 8.8 | 7.5 | 10.9 | 3 | 3 | 4 |
| 10 | 45 | 170 | 300 | 7.6 | 10.3 | 11.5 | 3 | 5 | 5 |

As is clear from Table 2, samples 3, 6 and 9 prepared by using only the alkylene oxide derivatives were improved in contrast and dot quality when the development time was extended but, in general, they took a long period of time for the development, had a marked decrease in speed during the first half of the development and could not provide any satisfactory dot quality. Further, samples 2, 5 and 8 prepared by using only the hydroimidazo-s-triazine compounds had a shorter development time than the above-mentioned samples and were greatly increased in speed, but were markedly deteriorated in contrast and dot quality. In contrast thereto, samples 4, 7 and 10 prepared by using the two compounds in combination showed, throughout the whole period of development, markedly excellent characteristics in every one of speed, contrast and dot quality, as compared with the control sample 1.

EXAMPLE 2

The same emulsion as used for preparation of sample 1 in Example 1 was coated on two film bases. On each of the resulting emulsion layers, a protective layer was formed by use of each of the gelatine solutions shown in Table 3 to prepare samples 11 and 12.

Table 3

| Sample No. | Protective layer solution |
|---|---|
| 11 | 2% Gelatine solution |
| 12 | Solution obtained by adding to the above-mentioned gelatine solution each 0.2 g/liter of the compound (IX) and the compound (3) |

The samples were treated under the same conditions as in Example 1 to obtain the results set forth in Table 4.

Table 4

| Development time | Relative speed | | | Contrast | | | Evaluaton of dots | | |
|---|---|---|---|---|---|---|---|---|---|
| Sample No. | 1'30" | 3' | 4' | 1'30" | 3' | 4' | 1'30" | 3' | 4' |
| 11 | 13 | 84 | 180 | 4.2 | 5.5 | 6.3 | 1 | 2 | 2 |
| 12 | 42 | 200 | 310 | 7.9 | 10.9 | 11.5 | 3 | 4 | 4 |

As is clear from Table 4, sample 12 which had been incorporated in the protective layer with 2 kinds of the compounds according to the present invention was more excellent than the control sample 11 in every property of speed, contrast and dot quality.

We claim:

1. A process for lithographically developing a silver halide photographic material which has been imagewise exposed to light comprising developing said material with a lithographic developer comprising formaldehyde, sodium sulfite and hydroquinone as the sole developing agent, wherein the photographic material contains in at least one of the emulsion-layer and the layers adjacent thereto at least one hydroimidazo-s-triazine compound having at least one ring structure selected from the group consisting of

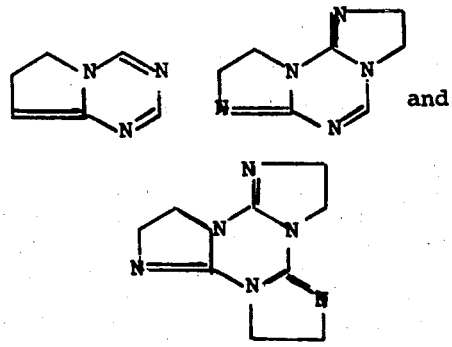

and said ring structure optionally having one or more substituents selected from the group consisting of hydroxy, lower alkoxy, lower alkyl, amino, amino hydrochloride and wherein two of said substituted or unsubstituted ring structures may be joined together by a group selected from —NH—$(CH_2)_x$NH— wherein $x = 2$ to 6,

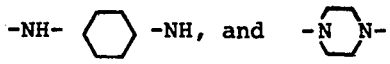

and

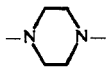

and a polyalkylene oxide derivative selected from the group consisting of the condensation products of alkylene oxides with water, aliphatic alcohols, aliphatic thioalcohols, glycols, fatty acids, amines, phenols, thiophenols and hexitols.

2. A process as claimed in claim 1, wherein said hydroimidazo-s-triazine compound has the chemical formula selected from the following:

(I)

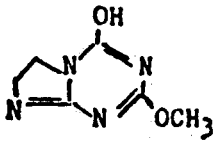

(II)

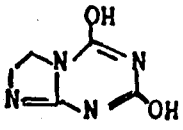

(III)

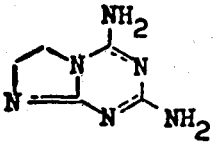

(IV)

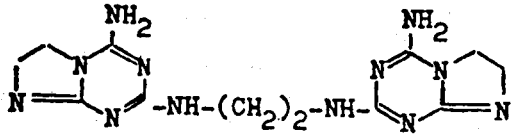

(V)
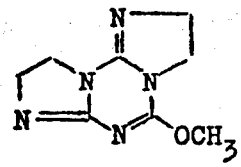
(VI)
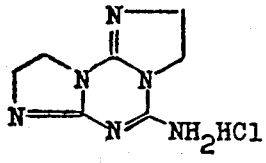
(VII)
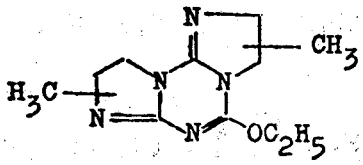
(VIII)
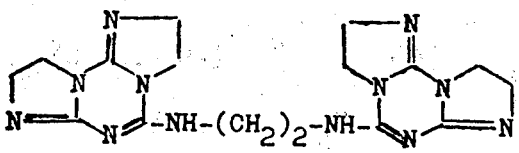
(IX)
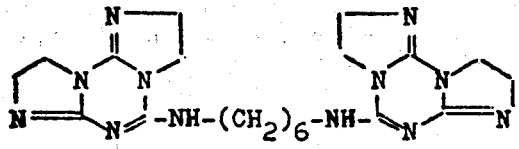
(X)
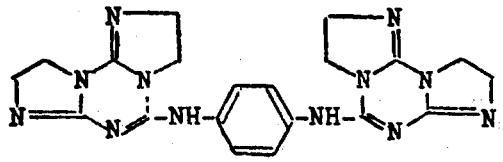
(XI)
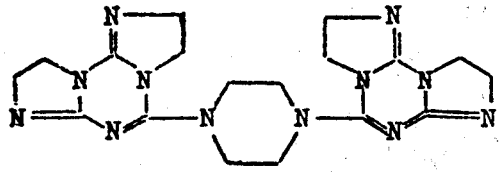
(XII)
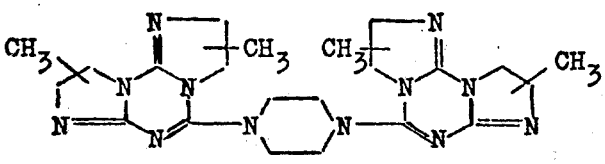

(XIII)
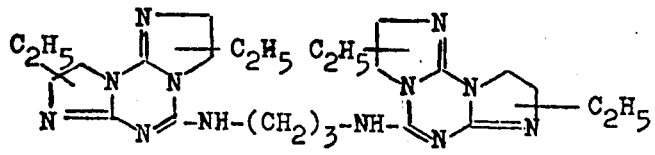
(XIV)
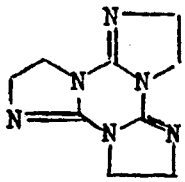
(XV)
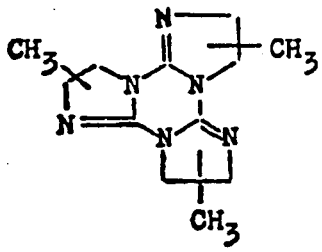
3. A process as claimed in claim 1 wherein said polyalkylene oxide derivative is selected from the group consisting of
1. $HO(C_2H_4O)_{50}H$
(2) 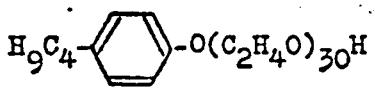
(3) 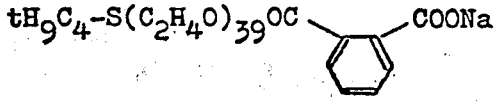
(4) 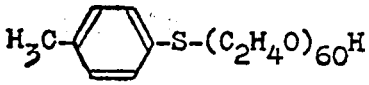
5. $H(OC_2H_4)_{40}-O-(CH_2)_4-O-(C_2H_4O)_{40}COCH_2CH_2COONa$
(6) 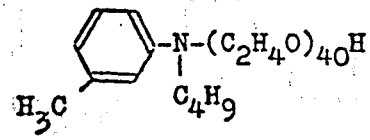
(7) 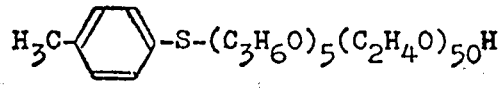
8. $H(OC_3H_6)_5(OC_2H_4)_{20}O(CH_2)_4O(C_2H_4O)_{20}(C_3H_6O)_5COCH_2CH_2COONa$
* * * * *